United States Patent [19]

Shimo et al.

[11] Patent Number: 4,844,736

[45] Date of Patent: Jul. 4, 1989

[54] METHOD FOR THE PREPARATION OF FINELY DIVIDED METAL PARTICLES

[75] Inventors: Nobuo Shimo, Ichihara; Keitaro Yoshihara, Okazaki; Nobuaki Nakashima, Suita, all of Japan

[73] Assignee: Idemitsu Kosan Co., Ltd., Tokyo, Japan

[21] Appl. No.: 114,448

[22] Filed: Oct. 29, 1987

[30] Foreign Application Priority Data

Nov. 4, 1986 [JP] Japan ..... 61-262535
Jul. 6, 1987 [JP] Japan ..... 62-168359

[51] Int. Cl.[4] ..... B22F 9/00
[52] U.S. Cl. ..... 75/0.5 B; 75/0.5 C; 75/0.5 R; 75/65 EB; 427/53.1
[58] Field of Search ..... 75/0.5 C, 0.5 B, 0.5 R, 75/65 EB; 427/53.1

[56] References Cited

U.S. PATENT DOCUMENTS

| | | | |
|---|---|---|---|
| 4,472,513 | 9/1984 | Menges-Hammond | 75/0.5 C |
| 4,474,604 | 10/1984 | Nakamura et al. | 75/0.5 C |
| 4,482,375 | 11/1984 | Sastry et al. | 75/0.5 C |
| 4,571,331 | 2/1986 | Endou et al. | 75/0.5 B |
| 4,619,691 | 10/1986 | Araya et al. | 75/0.5 R |

*Primary Examiner*—Stanley Silverman
*Attorney, Agent, or Firm*—Wyatt, Gerber, Burke and Badie

[57] ABSTRACT

A compound of a metallic element, e.g., tetramethyl lead, trimethyl bismuth, etc. in a vapor phase can be efficiently decomposed in a chain reaction of a very large apparent quantum yield to form extremely finely divided high-purity particles of the metallic element by the irradiation with actinic rays, e.g., laser beams, when the concentration of the metallic compound in the vapor phase is at least $1\times10^{15}$ molecules per $cm^3$ and the energy density of the actinic rays is at least $1\times10^{-3}$ Joule per $cm^2$.

15 Claims, No Drawings

METHOD FOR THE PREPARATION OF FINELY DIVIDED METAL PARTICLES

BACKGROUND OF THE INVENTION

The present invention relates to a method for the preparation of finely divided metal particles or, more particularly, to a method for the preparation of finely divided particles of a metal by the vapor-phase decomposition reaction of a vaporizable compound of the metal ignited by the irradiation with actinic rays.

Along with the progress of various modern technologies in recent years, metallic materials are required to be supplied in a finely divided particulate form. Needless to say, various methods in the prior art are known and practiced for the preparation of metal powders but none of the conventional methods can provide a metal powder to meet the requirements in the modern high technologies. A method is proposed in Japanese Patent Kokai 60-51539 according to which powders of metals can be obtained as a deposit by the vapor-phase chemical decomposition from a vaporizable compound of the metallic element. As a means to effect vapor-phase chemical decomposition of a vaporizable metal compound, use of laser beams is suggested in Chemistry and Industry, volume 15, pages 247–251 Apr. 15, 1985). This journal article, however, is directed to a subject matter of preparing a thin coating film of a metal or a compound semiconductor on a substrate surface by the method of chemical vapor deposition so that nothing is described there on the conditions by which deposit of a metal by the laser beam-ignited vapor-phase decomposition could be obtained in a finely divided particulate form.

It is generally understood in the prior art of the laser beam-induced vapor-phase decomposition of a vaporizable metal compound that a photon of the laser beam is effective on an average only to produce one or less of the metal atoms or the so-called quantum yield is very low. Therefore, the method cannot be an industrially advantageous process in respect of the prohibitively high production costs due to the great consumption of the laser beam energy or requirement of installing a very expensive high-output laser equipment in addition to the problems of the poor controllability of the reaction and contamination of the product by the by-product impurities to cause a problem in the product quality.

SUMMARY OF THE INVENTION

It is therefore an object of the present invention to provide a method for the preparation of finely divided particles of a metal by the laser beam-ignited vapor-phase decomposition of a vaporizable compound of the metal without the above mentioned problems in the prior art methods in respect to the production efficiency and the product quality.

The method of the present invention completed as a result of the extensive investigations undertaken with the above mentioned object is based on a principle that the reaction of the laser beam-ignited vapor-phase decomposition of a vaporizable metal compound can proceed as a chain reaction of high quantum yield only when the laser beams for the irradiation of the vapor of the metal compound has a sufficiently large energy density relative to the irradiation cross section and time and the concentration of the metal compound in the vapor phase is larger than a critical value.

Thus, the method of the present invention for the preparation of finely divided particles of a metal comprises: irradiating a compound of the metal in a vapor phase containing at least $1\times10^{15}$ molecules per $cm^3$ of the metal compound with actinic rays, such as laser beams, having an energy density of at least $1\times10^{-3}$ Joule per $cm^2$.

It is not necessary that whole volume of the vapor phase is irradiated by the actinic rays but only a part can be irradiated since the vapor-phase decomposition as a chain reaction can readily and rapidly be propagated throughout the whole volume of the vapor phase provided that the irradiation with the actinic rays, e.g., laser beams is performed under the above specificed conditions to produce active species in a high concentration as an initiator of the propagating reaction.

DETAILED DESCRIPTION OF THE PREFERRED EMBODIMENTS

The starting material in the inventive method is a vaporizable metal compound. It should be understood that the term "metal" here implied includes not only intrinsic metals such as lead, thallium, zinc, cadmium, mercury and the like but also so-called metalloids such as bismuth, antimony and the like. The type of the compound of these metallic elements is not particularly limitative provided that the compound has a vapor pressure to satisfy the above mentioned requirement that the concentration of the compound in the vapor phase should be at least $1\times10^{15}$ molecules per $cm^3$. Suitable metallic compounds include organometallic compounds having a bond between an atom of the metallic element and carbon atom in an organic group such as alkyl, alkenyl, aryl and aralkyl groups as well as organic and inorganic compounds of the metallic element such as hydrides, alkoxides, carbonyls and so on. Particularly preferable metal compounds should have a relatively small bond energy and relatively high vapor pressure in order to ensure smooth initiation of the vapor-phase decomposition in a chain reaction and to obtain a sufficiently high concentration of the compound in the vapor phase. For example, organometallic compounds, of which the organic group has a small number of carbon atoms, are preferred in respect of the high vapor pressure and organometallic compound with lower alkyl groups and metal carbonyls are preferred in respect of the small bond energy.

Exemplary of the metallic compounds suitable as the starting material of the inventive method are tetramethyl lead, tetraethyl lead, trimethyl bismuth, trimethyl thallium, dimethyl mercury, dimethyl zinc, diethyl zinc, dimethyl cadmium, diethyl cadmium and the like.

The concentration of the metallic compound in the vapor phase should be at least $10^{15}$ molecules per $cm^3$ or, preferably, at least $10^{17}$ molecules per $cm^3$ in order to ensure smooth propagation of the vapor-phase decomposition reaction. It is optional with an object to control the particle size distribution of the metal particles that the vapor of the metallic compound is diluted with an inert diluent gas such as helium, argon, nitrogen, hydrogen, air and the like though with a possibility of reacting with the metal particles depending on the reactivity between the diluent gas and the metal. When a diluent gas is used, the concentration thereof should be twice or lower of the concentration of the metallic compund or, preferably, equal to or lower than the concentration of the metallic compound. The vapor of the metallic compound and the diluent gas are introduced into the reaction chamber separately or as mixed together before introduction into the chamber.

It is important that the concentration of the vapor of the metallic compound in the vapor phase should be adequately selected in relation to the energy absorption coefficient or molar extinction coefficient of the metallic compound. When laser beams are used as the actinic rays, for example, the vapor-phase decomposition of the metallic compound as a chain reaction can smoothly be started even in a vapor phase of a relatively low concentration of the metallic compound by using a laser beam of a wavelength or frequency at which the metallic compound has a large molar extinction coefficient. It is not possible to start the chain reaction of the vapor-phase decomposition does not start when the concentration of the metallic compound in the vapor phase is too low since the concentration of the active species produced by the irradiation with actinic rays is consequently low and the active species may be deactivated and cannot enter the propagating reaction before the end of the life thereof.

Various kinds of actinic rays can be used as the energy source used in the method of the invention including, for example, electromagnetic waves, e.g., ultraviolet, visible and infrared lights emitted from lasers, noncoherent ultraviolet light from mercury lamps and xenon lamps, orbital radiation, microwaves, X-rays, etc., ion beams, electron beams, plasma and the like provided that the energy of the actinic rays can be efficiently absorbed by the metallic compound in the vapor phase to produce active species which are effective to start the propagating reaction. Exemplary of preferable actinic rays are light beams emitted from a laser or, in particular, excimer laser in respect of the large energy density and absorption coefficient in the metallic compound to efficiently produce active species of the compound. Orbital radiation and X-rays are also preferable in respect of the large excitation energy.

When tetramethyl lead is used as the starting metallic compound, for example, the maximum value of the molar extinction coefficient of the compound is obtained at a wavelength of about 200 nm so that quite satisfactory results can be obtained by using an ArF excimer laser which emits laser beams at a wavelength of 193 nm. In particular, the output of an ArF excimer laser should be large enough to give at least $10^{15}$ photons per $cm^2$ or, preferably, at least $10^{16}$ photons per $cm^2$ so that the concentration of the active species produced by the irradiation can be sufficiently high. It is convenient and advantageous that the irradiation is performed in the form of a pulse in order to ensure a high energy density although the irradiation may be performed with a continuous steady-state beam.

The duration of the irradiation or the width of the irradiation pulse should be adequately selected depending on the type of the metallic compound as the starting material of the inventive method. It usually does not exceed $1\times10^{-3}$ second or, preferably, $1\times10^{-5}$ second or, more preferably, $1\times10^{-6}$ second.

When the method of the present invention is conducted under the above described specific conditions, the molecules of the metallic compound existing in the volume portion of the vapor phase under irradiation with the actinic rays are efficiently decomposed to produce active species in a high concentration from which the decomposition reaction is propagated as a chain reaction throughout the whole volume of the vapor phase so that the metallic compound contained in the vapor phase is almost completely decomposed instantaneously to produce finely divided particles of the metal. The finely divided metal particles prepared in this manner usually has a particle diameter not exceeding 1 μm or, mostly, 0.3 μm.

As is understood from the above given description, the industrial advantage of the inventive method is very great since only a small quantity of the energy of the actinic rays is sufficient to decompose the whole amount of the metallic compound in the vapor phase to be converted into a fine metallic powder and the advantage would be more prominent when the inventive method is practiced in a larger scale using a larger reaction chamber.

In the following, the method of the invention is illustrated in more detail by way of examples and comparative examples.

EXAMPLE 1

A reaction chamber of 100 ml capacity having a window of synthetic quartz glass was filled with vapor of 0.167 m mole, i.e. $1.0\times10^{20}$ molecules, of tetramethyl lead at room temperature (295° K.) under a pressure of 30.7 Torr. The concentration of the vapor of the metallic compound in the chamber corresponded to $1.0\times10^{18}$ molecules per $cm^3$.

The vapor in the reaction chamber was irradiated through the window of the chamber with laser beams at a wavelength of 193 nm emitted from an ArF excimer laser having a peak output corresponding to an energy density of $2.5\times10^{-2}$ Joule per 1 $cm^2$ cross section of the beams in a pulse having a width of $1\times10^{-8}$ second. The quantity of energy introduced into the vapor phase corresponded to 2.4 x $10^{16}$ photons. It could be estimated that more than 99.9% of the energy of the laser beams was absorbed by the vapor within about 1.8 mm from the window of the chamber through which the laser beams were introduced into the vapor phase in the chamber. This fact meant that the concentration of the active species produced from the molecules of tetramethyl lead was extremely high and localized in the vicinity of the chamber window.

When the vapor of tetramethyl lead was irradiated with the pulsed laser beams, a vapor-phase decomposition reaction of the lead compound took place inside the reaction chamber. When the reaction occurred, a flash of visible light was observed. A fine black powder was found on the wall of the reaction chamber. This powdery product, weighing 34 mg, was identified to be particles of metallic lead mostly having a particle diameter of 0.3 μm or less. The yield of the lead powder corresponded to an efficiency that about 4000 molecules of tetramethyl lead were decomposed by the irradiation of a single photon indicating a very high apparent quantum yield of the chain reaction. This yield is of course very high as compared to the yields in the prior art methods but, more advantageously, the yield can be increased still more by increasing the capacity of the reaction chamber.

The gas contained in the reaction chamber after the above described reaction was analyzed and found that it was composed of 64%, 11%, 19% and 6%, each by volume, of ethane, ethylene, methane and propylene, respectively.

EXAMPLE 2

A reaction chamber of 1 liter capacity having a window of synthetic quartz glass was filled with vapor of 1.6 m moles of tetramethyl lead at room temperature (295° K.) under a pressure of 29.4 Torr. The concentration of the vapor of the metallic compound in the chamber corresponded to $9.6\times10^{17}$ molecules per $cm^3$.

The vapor in the reaction chamber was irradiated through the window of the chamber with laser beams at a wavelength of 193 nm emitted from an ArF excimer laser having a peak output corresponding to an energy density of $1.0\times10^{-2}$ Joule per 1 $cm^2$ cross section of the beams in a pulse having a width of $1\times10^{-8}$ second. The quantity of energy introduced into the vapor phase was $4.0\times10^{-2}$ Joule, corresponding to $9.6\times10^{15}$ photons. It could be estimated that more than 99.9% of the energy of the laser beams was absorbed by the vapor within about 1.9 mm from the window through which the laser beams were introduced into the vapor phase in the chamber. This fact meant that the concentration of the active species produced from the molecules of tetramethyl lead was extremely high and localized in the vicinity of the window.

When the vapor of tetramethyl lead was irradiated with pulsed laser beams, a vapor-phase decomposition reaction of the lead compound took place inside the reaction chamber. When the reaction occurred, a flash of visible light was observed. A fine black powder was found on the wall of the reaction chamber. This powdery product, weighing 326 mg, was identified to be particles of metallic lead mostly having a particle diameter of 0.3 μm or less. The yield of the lead powder correspond to an efficiency that about 100,000 molecules of tetramethyl lead were decomposed by the irradiation of a single photon indicating the very high apparent quantum yield of the chain reaction. This yield is of course very high as compared to the yields in the prior art methods but, more advantageously, the yeild can be increased still more by increasing the capacity of the reaction chamber. Accordingly, the method of the present invention is of a great practical value by applying the method in an industrial scale.

EXAMPLE 3

A reaction chamber of 85 ml capacity having a window of synthetic quartz glass was filled with vapor of 0.1 m mole, i.e. $6.0\times10^{19}$ molecules, of trimethyl bismuth at 295° K. under a pressure of 21.6 Torr. The concentration of the vapor of the compound in the chamber corresponded to $7.1\times10^{17}$ molecules per $cm^3$.

The vapor in the reaction chamber was irradiated through the window of the chamber with laser beams at a wavelength of 193 nm emitted from an ArF excimer laser having a peak output corresponding to an energy density of $1.0\times10^{-1}$ Joule per 1 $cm^2$ cross section of the beams in a pulse having a width of $1\times10^{-8}$ second. When the vapor of trimethyl bismuth was irradiated with pulsed laser beams, a vapor-phase decomposition of the bismuth compound took place inside the reaction chamber. When the reaction occurred, a flash of visible light was observed.

A fine black powder was found on the wall of the reaction chamber. This powdery product, weighing 20.9 mg, was identified to be particles of metallic bismuth mostly having a particle diameter of 0.3 μm or less. The amount of the bismuth powder indicated that the vapor of the starting bismuth compound was almost completely decomposed by a single pulse of the laser beam irradiation corresponding to a yield of almost 100%.

The gas contained in the reaction chamber after the above described reaction was analyzed and found that it was composed of 83%, 11%, 3% and 3%, each by volume, of ethane, methane, ethylene and propylene, respectively.

EXAMPLE 4

A reaction chamber of 1 liter capacity having a window of synthetic quartz glass was filled with vapor of 0.55 m mole, i.e. $3.3\times10^{20}$ molecules, of trimethyl bismuth at 295° K. under a pressure of 10.1 Torr.

The vapor in the reaction chamber was irradiated through the window of the chamber with laser beams at a wavelength of 193 nm emitted from an ArF excimer laser having a peak output corresponding to an energy density of $2.5\times10^{-2}$ Joule per 1 $cm^2$ cross section of the beams in a pulse having a width of $1\times10^{-8}$ second. The quantity of energy introduced into the vapor phase corresponded to $1.0\times10^{-1}$ Joule.

A fine black powder was found on the wall of the reaction chamber. This powdery product, weighing 115 mg, was identified to be particles of metallic bismuth mostly having a particle diameter of 0.3 μm or less. The yield of the bismuth powder corresponded to an efficiency that about 14000 molecules of trimethyl bismuth were decomposed by the irradiation of a single photon indicating the very high apparent quantum yield of the chain reaction. The amount of the bismuth powder indicated that the vapor of the starting bismuth compound was almost completely decomposed by a single phase corresponding to a yield of almost 100%.

The gas contained in the reaction chamber after the above described reaction was analyzed and found that it was composed of 83%, 11%, 3% and 3%, each by volume, of ethane, methane, ethylene and propylene, respectively.

EXAMPLE 5

The experimental procedure was substantially the same as in Example 3 described above except that the amount of trimethyl bismuth was decreased to 0.046 m mole to produce 9.7 mg of a fine black powder of metallic bismuth of particles mostly having a diameter of 0.3 μm or less.

EXAMPLE 6

The experimental procedure was substantially the same as in Example 4 described above except that the amount of trimethyl bismuth was decreased to 0.23 m mole to produce 48.5 mg of a fine black powder of metallic bismuth of particles mostly having a diameter of 0.3 μm or less.

Comparative Example 1

The experimental procedure was substantially the same as in Example 1 except that the amount of the tetramethyl lead introduced into the reaction chamber was 0.166 m mole and the energy density per 1 $cm^2$ cross section of the laser beams was $1\times10^{-5}$ Joule. The vapor-phase decomposition of the lead compound as a chain reaction did not occur in the reaction chamber excepting a very thin film-like deposition of lead on the spot of the chamber window through which the laser beams were introduced into the chamber.

Comparative Example 2

The experimental procedure was substantially the same as in Example 1 except that the amount of the tetramethyl lead introduced into the reaction chamber was $1.1\times10^{-5}$ m mole. The vapor-phase decomposition of the lead compound as a chain reaction did not occur in the reaction chamber excepting a very thin film-like deposition of lead on the spot of the quartz glass window through which the laser beams were introduced into the chamber.

Comparative Example 3

The experimental procedure was substantially the same as in Example 3 except that the amount of the trimethyl bismuth introduced into the reaction chamber was 0.046 m mole and the intensity of the laser beam energy introduced into the vapor phase was $1\times10^{-5}$ Joule per $cm^2$. No vapor phase decomposition of the bismuth compound as a chain reaction occured in the reaction chamber excepting a very thin film-like deposition of bismuth on the spot of the quartz glass window through which the laser beams were introduced into the chamber.

What is claimed is:

1. A method for the preparation of finely divided particles of a metallic element which comprises irradiating a compound of the metallic element in a vapor phase containing at least $1\times10^{15}$ molecules of the compound per $cm^3$ with rays of a laser beam having an energy density of at least $1\times10^{-3}$ Joule per $cm^2$.

2. The method for the preparation of finely divided particles of a metallic element as claimed in claim 1 wherein the compound of the metallic element is an organic compound of the metallic element.

3. The method for the preparation of finely divided particles of a metallic element as claimed in claim 1 wherein the compound of the metallic element is selected from the group consisting of tetraalkyl leads and trialkyl bismuths.

4. The method for the preparation of finely divided particles of a metallic element as claimed in claim 1 wherein the vapor phase contains at least $1\times10^{16}$ molecules of the compound per $cm^3$.

5. The method for the preparation of finely divided particles of a metallic element as claimed in claim 1 wherein the vapor phase contains at least $1\times10^{17}$ molecules of the compound per $cm^3$.

6. The method for the preparation of finely divided particles of a metallic element as claimed in claim 1 wherein the vapor phase of the metallic compound is diluted with up to an equal concentration of an inert diluent gas.

7. The method for the preparation of finely divided particles of a metallic element as claimed in claim 6 wherein the diluent gas is selected from the group consisting of helium, argon, nitrogen, hydrogen and air.

8. The method for the preparation of finely divided particles of a metallic element as claimed in claim 2 wherein the vapor phase of the metallic compound is diluted with up to an equal concentration of an inert diluent gas.

9. The method for the preparation of finely divided particles of a metallic element as claimed in claim 8 wherein the diluent gas is selected from the group consisting of helium, argon, nitrogen, hydrogen and air.

10. The method for the preparation of finely divided particles of a metallic element as claimed in claim 3 wherein the vapor phase of the metallic compound is diluted with up to an equal concentration of an inert diluent gas.

11. The method for the preparation of finely divided particles of a metallic element as claimed in claim 10 wherein the diluent gas is selected from the group consisting of helium, argon, nitrogen, hydrogen and air.

12. The method for the preparation of finely divided particles of a metallic element as claimed in claim 4 wherein the vapor phase of the metallic compound is diluted with up to an equal concentration of an inert diluent gas.

13. The method for the preparation of finely divided particles of a metallic element as claimed in claim 12 wherein the diluent gas is selected from the group consisting of helium, argon, nitrogen, hydrogen and air.

14. The method for the preparation of finely divided particles of a metallic element as claimed in claim 5 wherein the vapor phase of the metallic compound is diluted with up to an equal concentration of an inert diluent gas.

15. The method for the preparation of finely divided particles of a metallic element as claimed in claim 14 wherein the diluent gas is selected from the group consisting of helium, argon, nitrogen, hydrogen and air.

* * * * *